US005325109A

United States Patent [19]

Duckworth

[11] Patent Number: 5,325,109

[45] Date of Patent: Jun. 28, 1994

[54] METHOD AND APPARATUS FOR MANIPULATION OF PIXEL DATA IN COMPUTER GRAPHICS

[75] Inventor: Mark R. Duckworth, Londonderry, N.H.

[73] Assignee: CalComp Inc., Anaheim, Calif.

[21] Appl. No.: 952,139

[22] Filed: Sep. 28, 1992

Related U.S. Application Data

[63] Continuation of Ser. No. 634,600, Dec. 27, 1990, abandoned.

[51] Int. Cl.[5] ..... G09G 1/28

[52] U.S. Cl. ..... 345/155.1; 345/199; 345/132

[58] Field of Search ..... 340/701, 703, 747, 799, 340/798

[56] References Cited

U.S. PATENT DOCUMENTS 4,751,446 6/1988 Dineda et al. ..... 340/703
4,857,901 8/1989 Luthrop ..... 340/799
4,910,687 3/1990 Butler et al. ..... 340/799

OTHER PUBLICATIONS

XILINX, SC2064, XC2018, XC3020, XC3042, XC3090, XC3030, XC3064 Logic Cell Array, product Brief pp. 1-5, undated.

*Primary Examiner*—Alvin E. Oberley
*Assistant Examiner*—Regina Liang
*Attorney, Agent, or Firm*—Robert G. Crooks

[57] ABSTRACT

This is a method and apparatus for use in the "color-graphics board" of a computer having a pictorial output visualizable in color. It is particularly suitable for use with computers of the Macintosh type of configuration, but is by no means limited to computers of that type. The invention affords to the operator of the computer the ability to select various bit levels for the pixels which together comprise the display of the computer. The bit levels may be selected at will depending upon the necessary degree of resolution and color selectability that characterize the diverse possible uses of the visual display of the computer.

10 Claims, 4 Drawing Sheets

CONFIGURABLE LOGIC BLOCK

METHOD AND APPARATUS FOR MANIPULATION OF PIXEL DATA IN COMPUTER GRAPHICS

This is a continuation of copending application Ser. No. 07/634,600 filed on Dec. 27, 1990 now abandoned.

This invention relates to a method and apparatus for the handling of pixel data for the displays of computers that have graphic outputs. Such displays are often formed on the face of a color-cathode-ray tube by means of circuitry on a "color-graphics board," which may be included in or added to a computer for the purpose of developing and making available to the color-cathode-ray tube the data necessary for the presentation of the display. In particular, the invention relates to a method and apparatus for "adjusting" the number of data bits per pixel of the cathode-ray-tube display in accordance with the resolution and color requirements of the display.

BACKGROUND OF THE INVENTION

The cathode-ray tube is, of course, an analog device capable of displaying in a continuous fashion the data supplied to its electron guns and its deflection plates and governing respectively the intensity and the location of the illuminated spots which together constitute the display on the face of the cathode-ray tube. The intensity of the spots is a function of the voltages on the electron guns, while the location of the spots is a function of the voltage differences on the respective pairs of deflection plates. Although the cathode-ray tube is inherently capable of presenting a continuous display controlled by the aforementioned respective voltages, the computer circuitry which usually generates those voltages is digital in nature and hence produces discrete and discontinuous bits of data. Those bits of data are assembled in a large-capacity contiguous memory element called a "frame buffer." The frame buffer maintains available for "accessing" a large amount of address, intensity, and often color data. These data are arranged in the form of a matrix of memory cells, each of which represents the address, intensity, and possibly the color of a certain small elementary portion of the image to be displayed on the face of the cathode-ray tube. In view of the digital nature of the data so assembled in the frame buffer or similar memory element, the corresponding locations on the face of the cathode-ray tube may be considered as a "raster" of horizontal lines and vertical columns. At the intersection of each such horizontal line and vertical column of the raster, we may visualize a small element of area on the face of the cathode-ray tube called a picture element or "pixel." Thus, it becomes possible to employ the data stored in the frame buffer to control the address, intensity and color of each of the pixels included within the raster of the image on the face of the cathode-ray tube. In employing the digital data stored in the frame buffer to control the address, intensity, and color of each pixel, it is first necessary to convert the aforementioned data from digital form into analog form. This conversion is generally performed by a device known as a "digital-to-analog-converter." In the case of a color display, there is generally one digital-to-analog-converter ("DAC") for each of the primary colors (red, green, and blue) which are necessary in defining the color of every pixel to be displayed.

In some applications of computer graphics, it is not necessary to have a full-color display as produced by a cathode-ray tube having an electron gun for each of the aforementioned primary colors. For these applications, a single electron gun may suffice for the purposes of the display. If desired, the intensity of each illuminated spot on the face of the cathode-ray tube may still be controlled by supplying a modulated voltage to the single electron gun of the cathode-ray tube. An arrangement of this type permits the generation of a display having portions which are fully illuminated, other portions which are not illuminated at all, and still further portions which are illuminated to some controllable degree, thereby generating on the screen of the cathode-ray tube pixel images in shades of gray somewhere between black and white.

A still further variation, which may be satisfactory in some elementary applications, requires only that each pixel in the image on the face of the cathode-ray tube be either "on" or "off," i.e., that the pixel be either illuminated or not illuminated, as the case may be, in accordance with data derived from the frame buffer.

In the last-mentioned application, the data requirements for each pixel of image are very simple—only one bit of digital data is required in order to specify whether a pixel is to be activated or not activated. On the other hand, if various shades of gray between white and black are required in the presentation of pixels forming the image on the face of the cathode-ray tube, the data requirements may be as much as eight bits per pixel to be displayed. This amount of data permits display of a so-called "gray-scale" comprising $2^8$ (or 256) shades of gray.

One early computer-graphics system had a display which was in color, but the colors were drawn from a very limited "palette" of 16 possible hues. As in the case of the "gray scale," this system required eight bits of data for each pixel to be displayed.

An improved display, called "Chroma Vision Plus," required eight bits of digital data for each of the primary colors to be included in the resultant color characterizing each pixel to be displayed. Since eight bits were required for each of the primary colors, the total requirement of "Chroma Vision Plus" was 24 bits of digital data. This improvement, for the "high end" of the market, enabled the presentation of a color image in which each pixel could have a composite hue selected from a total of more than 16 million possibilities ($2^{24}$).

In a computer-graphics electronic circuit, the computation of address, intensity and color data for each pixel to be displayed is usually performed in a microprocessor under the control of a program memory which is specially designed for that purpose. The microprocessor may be part of the "color-graphics board," which is a supplement to the computer. Alternatively, the microprocessor may be part of the central processing unit of the computer itself if the available time of the "CPU" microprocessor is sufficient for the purpose of specifying the intensity and color of individual pixels of the display. Conventionally, the address and color data developed by the microprocessor are furnished to a sub-assembly which may be called a "pixel-memory controller." The pixel-memory controller performs any further operations that are necessary to prepare the outputs of the microprocessor for entry in the frame buffer. The improvements in accordance with the present invention relate principally to a "pixel-data controller," i.e., all circuitry interposed between the frame buffer and the color circuitry (the "color-look-up table.")

Prior to the present invention, there has not been any pixel-data controller which efficiently implements the provision and selection of an appropriate number of bits of data to fulfill—but not overfulfill—the requirements of different types of display device. There have been various "jerry-built" assemblages of discrete semiconductor components that have enabled a choice to be made among different levels of address and color data that could be developed by a microprocessor. However, these prior-art approaches to the problem have been complex in design and expensive to manufacture, and have not embodied a single integrated circuit capable of selecting the data necessary to satisfy the requirements of the particular display device to be employed. In short, there has been no single "elegant" means for selecting the data that are immediately needed and for maintaining available the data which are not immediately needed but which will later be required. Until now, the difficulties of design, the expense of manufacture, and the power requirements of prior-art approaches to this problem have all been discouragingly high.

OBJECTS OF THE INVENTION

In view of the deficiencies of the methods and apparatus of the prior art, as discussed in the foregoing paragraphs, it is an object of my invention to provide a pixel-data controller to replace the pixel-memory controllers of the prior art and to enable a convenient selection among the various available levels of bit rate per pixel of display.

It is another object of my invention to provide a pixel-data controller which implements the aforementioned functions in a single subcombination on the color-graphics board.

It is a further object of my invention to provide a method and apparatus for controlling pixel data to afford a single systematic response to the need for the ability to select the optimum one of a number of available levels of data bits per pixel of image to be displayed.

It is a still further object of my invention to provide a pixel-data controller that is economical in design, utilization of space, and manufacturing expense.

It is still another object of my invention to take advantage of recent developments in the integrated-circuit art as the source of a "hardware" component for fulfilling the aforementioned objects.

SUMMARY OF THE INVENTION

Briefly, I have fulfilled the above-mentioned and other objects of my invention by providing a novel pixel-data controller for interposition between the frame buffer and the color-look-up table on the color-graphics board and which can select among data levels from one bit per pixel through eight bits per pixel as derived from the microprocessor and the frame buffer. In implementing this objective, I employ a semiconductor integrated circuit including a "programmable gate array" that can be "reconfigured" in response to an external signal without any physical change or rearrangement of the elements of the integrated circuit. For this purpose, I prefer to use Logic-Cell Array Model XC-2018, as produced and marketed by Xilinx, Inc. of San Jose, Calif. The availability of the Xilinx programmable gate array has contributed to facilitating this invention. However, the successful implementation of the invention is based upon the way in which I instruct the programmable gate array concerning the choice among the available levels of bits per pixel of image, to be selected from the frame buffer for conversion into analog form and eventual display on the face of the cathode-ray tube.

BRIEF DESCRIPTION OF THE DRAWINGS

The invention summarized above will be described in detail in the following specification, which will be best understood if read while referring to the accompanying drawings, in which.

DESCRIPTION OF THE PREFERRED EMBODIMENT

Figure 1:
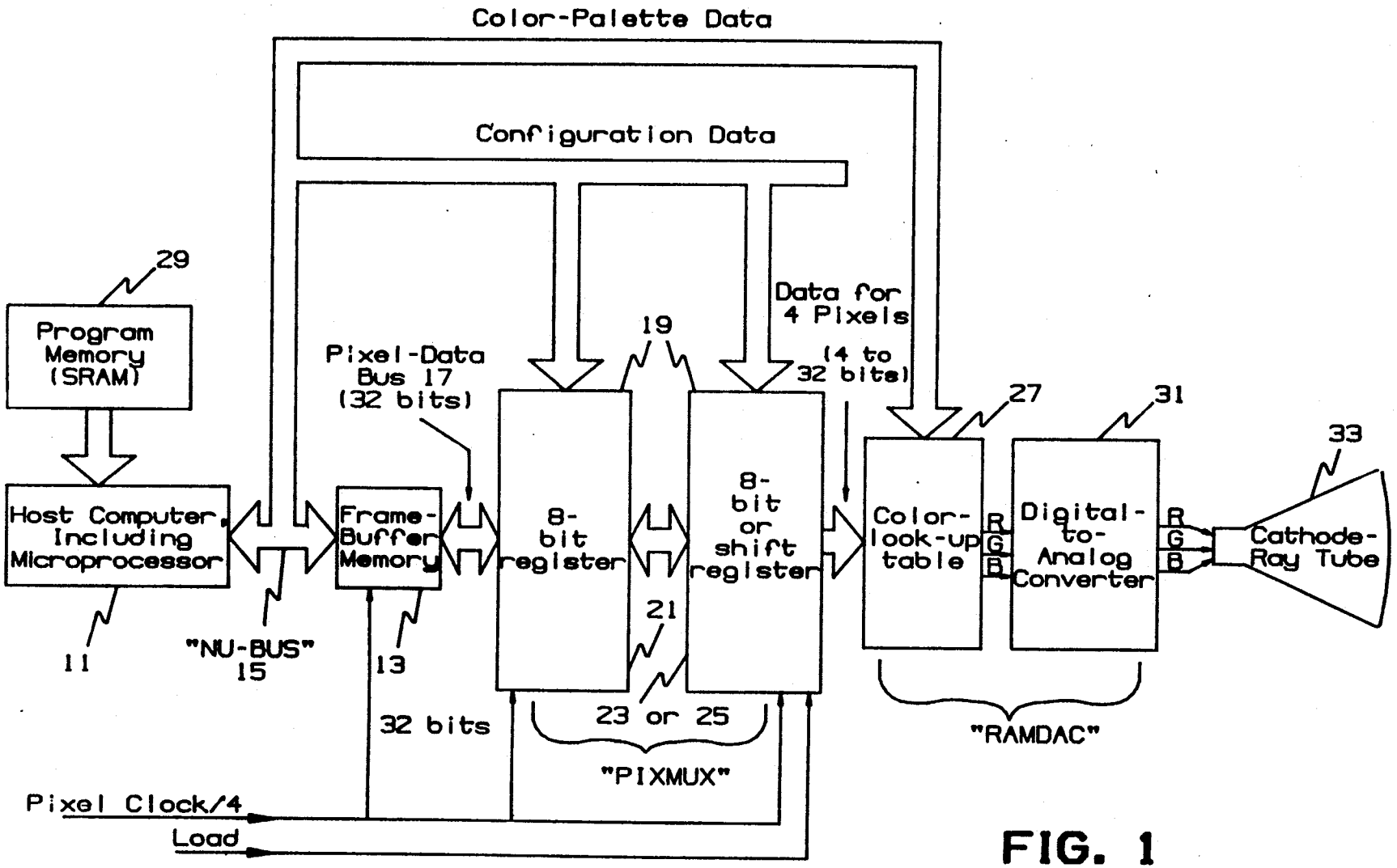
FIG. 1 of the drawings is a block diagram of the pixel-data controller in accordance with the invention, showing the path of flow of the pixel data from the host computer all the way to display means such as a color-cathode-ray tube.

Turning to the block diagram of FIG. 1, we find a host computer 11, which may be of the Macintosh or comparable configuration. Host computer 11 is connected to a frame-buffer memory 13 through a bus structure 15, which may be of a type known as "NU-BUS," marketed by Texas Instruments Inc. and used in Macintosh computers. Frame-buffer memory 13 may be of a conventional random-access type. Frame-buffer memory 13 is in turn connected through a pixel-data bus 17 to a chip device 19 which is a principal element of this invention and will be described in detail.

Figure 2:
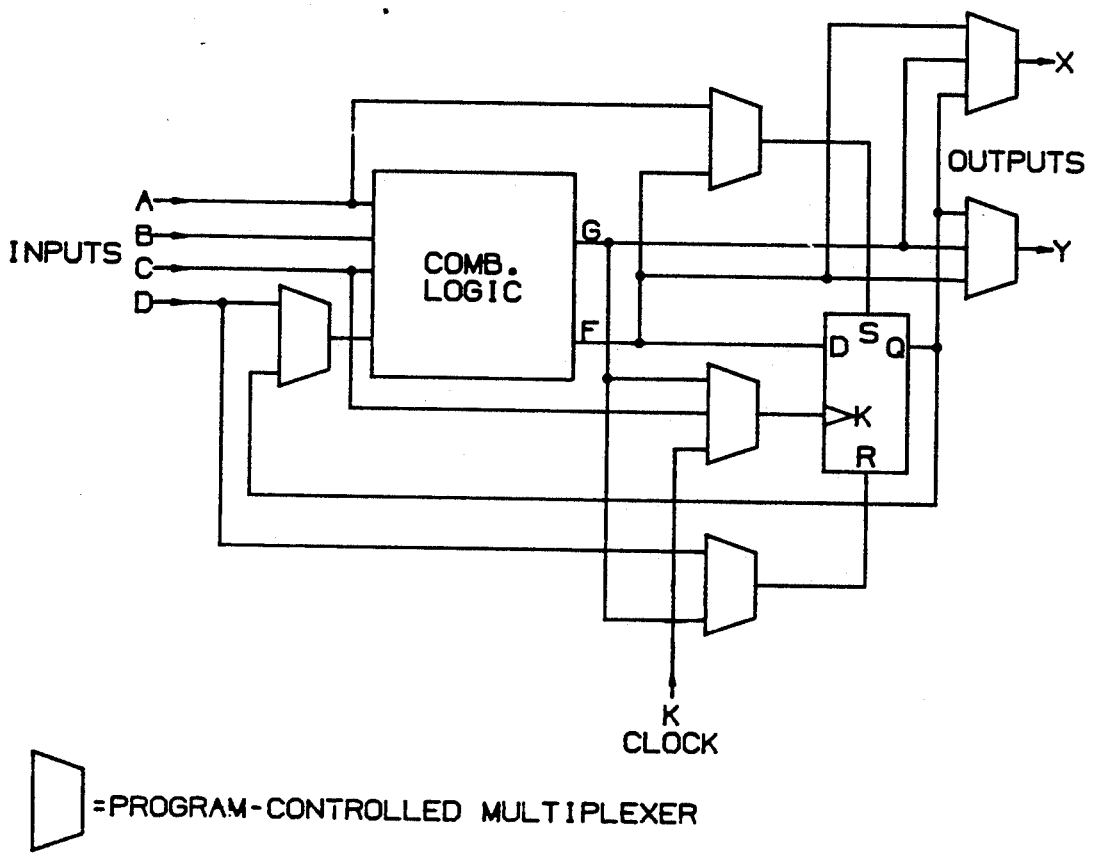
FIG. 2 is a block diagram of a "configurable logic block" which is one element of a programmable gate array that constitutes an important sub-assembly of the pixel-data controller in accordance with the invention.

Pixel-data bus 17 should have a width of at least 32 bits and should comprise at least 32 individual conductors. Thus, pixel-data bus 17 is capable of simultaneously deriving from frame-buffer memory 13 the data for four pixels having eight bits apiece. Chip device 19 is a programmable array of gates that can be configured either as eight eight-bit registers or as two 32-bit registers. A suitable and preferred type of programmable gate array is the Logic-Cell Array Model XC-2018 as produced and marketed by Xilinx, Inc. of San Jose, Calif. The logic-cell array comprises a matrix of configurable logic blocks as illustrated in FIG. 2 of the drawings. Model XC-2018 contains a matrix of 100 such configurable logic blocks. I refer to the combination contained in chip device 19 as a pixel multiplexer ("PIXMUX").

As the input of chip device 19 is a first eight-bit register 21. The precise function of first eight-bit register 21 and of the remainder of chip device 19 depends upon the mode of operation which is selected for the multiplexer and for chip device 19 in general. It is a feature of this invention that "PIXMUX" always outputs the data for four pixels. However, each pixel may have from one bit to eight bits of data, in accordance with instructions which are given to "PIXMUX" and which change the internal configuration of the programmable gate array of chip device 19. Thus, the output of chip device 19 may comprise from four to 32 bits of data, but will always comprise the data for four pixels to be displayed. As explained in the introductory paragraphs of this specification, the bit widths of the pixel will depend upon the requirements placed upon the pixel in terms of color and other types of data.

The instructions to "PIXMUX" of chip device 19 come from the host computer and microprocessor 11 via bus structure 15, as shown in FIG. 1 of the drawings. The instructions particularly relate to whether a second eight-bit register 23 in chip device 19 is to function as a mere "memory" or as a "shift register."

The instructions to be given to "PIXMUX" of chip device 19 are determined by a human operator of the computer system, who decides whether the output of chip device 19 is to be one, two, four, or eight bits per pixel. The human operator selects which of the four available modes of operation is to be employed. However, the basic routines to be followed, depending upon the choice of mode of operation, are recorded in a program memory 29, which establishes the "ground rules" for host computer and microprocessor 11. Program memory 29 may be a static-random-access memory ("SRAM") as shown in FIG. 1 of the drawings.

Figure 3:
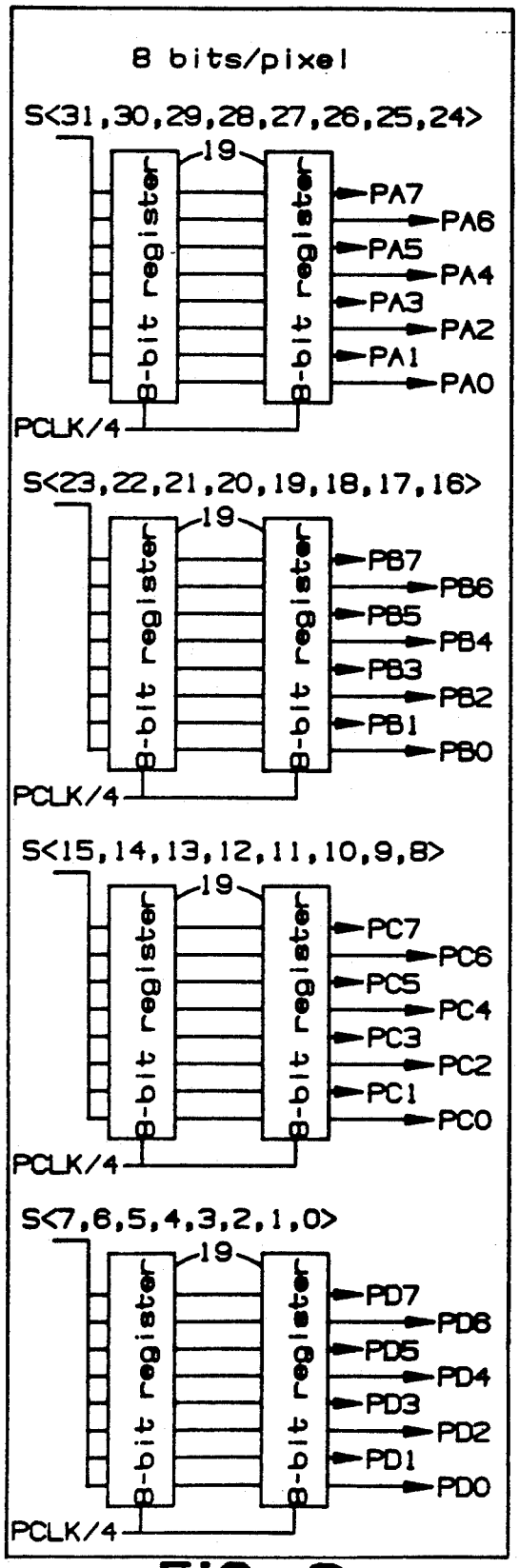
FIG. 3 is a schematic diagram of a programmable gate array programmed to produce data at the rate of eight bits per pixel to be displayed.

If the instructions given to chip device 19 require it to operate in the eight-bits-per-pixel mode, chip device 19 will be configured so that first eight-bit register 21 at its input and second eight-bit register 23 at its output both function as memories. For that mode of operation, the internal structure of chip device 19 is as shown in FIG. 3 of the drawings. In the eight-bit mode, the format of the input data (four pixels of eight bits each) exactly matches the desired output data format. Thus, "PIXMUX" simply passes the data through first eight-bit register 21 and second eight-bit register 23 without changing the format of the data. The input and output data rates are the same in the eight-bit mode of operation illustrated in FIG. 3 of the drawings. As shown in FIG. 3, chip device 19 is "strobed" by a periodic signal having one-quarter the frequency of the pixel clock. The outputs shown in FIG. 3 are four pixels, respectively denominated as PA, PB, PC, and PD. The respective bits of pixel PA, as illustrated in FIG. 3, are PA0 through PA7, a total of eight bits. The eight-bit mode is the simplest mode for operation of chip device 19, and produces data enabling pixels of the highest resolution to be activated.

Figure 4:
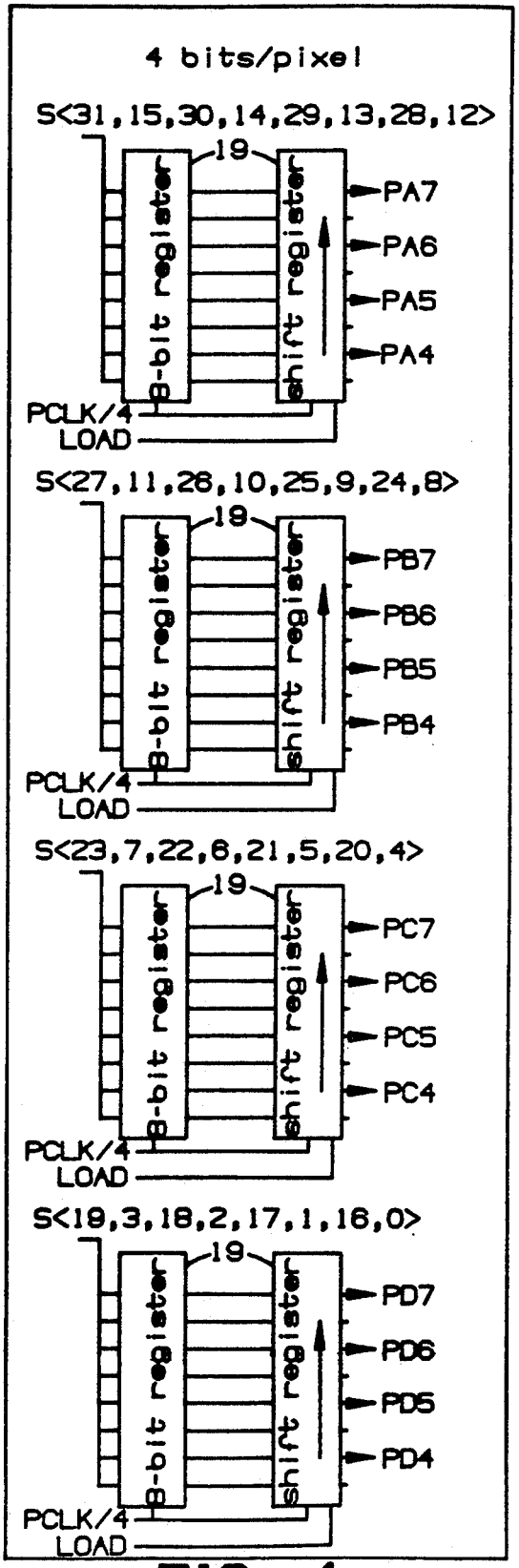
FIG. 4 is a schematic diagram of a programmable gate array programmed to produce data at the rate of four bits per pixel to be displayed.

If pixels having four bits of data are required, the configuration instructions given to chip device 19 are revised accordingly, and the device becomes internally re-programmed. In place of second eight-bit register 23, the output element of chip device 19 effectively becomes a shift register 25. In that event, a "load" command is given to the shift register, which thereupon produces four pixels, each having four bits of data. Once again, the pixels are denominated as PA, PB, PC, and PD, as shown in FIG. 4 of the drawings. For pixel PA, the respective bits are PA4, PA5, PA6 and PA7. For pixel PB, the respective bits are PB4, PB5, PB6, and PB7, and so on.

Figure 5:
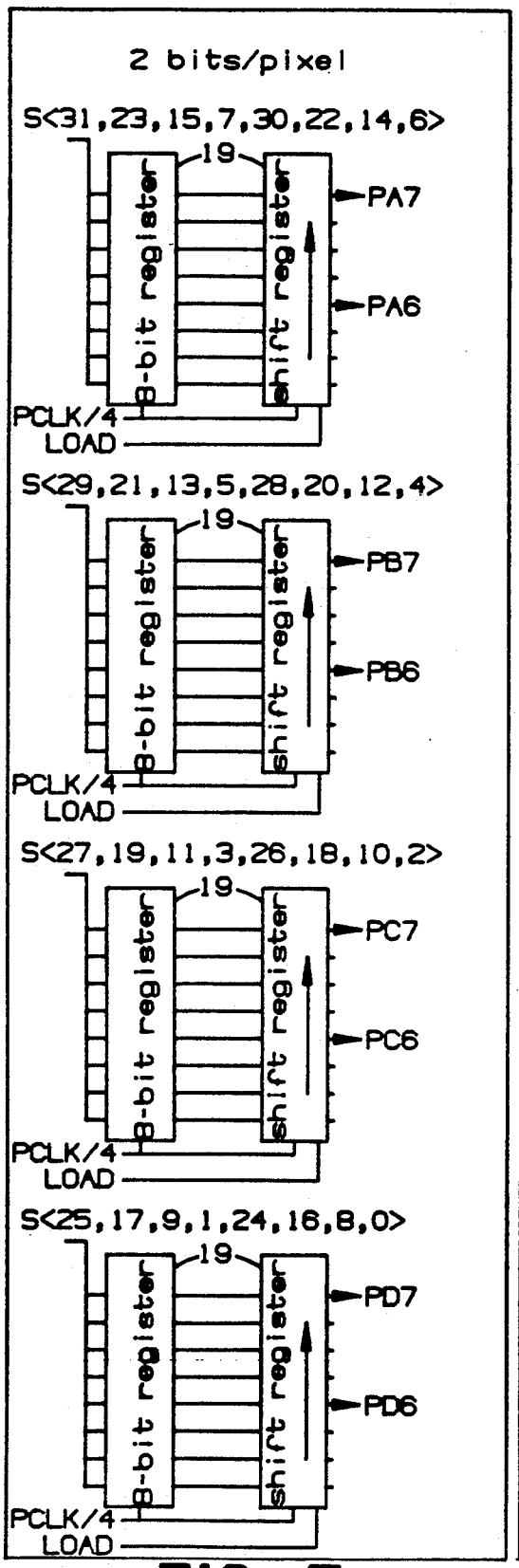
FIG. 5 is a schematic diagram of a programmable gate array programmed to produce data at the rate of two bits per pixel to be displayed.

If the requirement changes to become four pixels each having two bits, the effective internal configuration of chip device 19 becomes that which is shown in FIG. 5 of the drawings. Once again, the output is taken from shift register 25, which is strobed by a periodic signal at a frequency one-quarter that of the pixel clock. As shown in FIG. 5, a command is given to shift register 25 to load data and produce pixels having two bits each. Then, for pixel PA, the respective bits are PA6 and PA7. For pixel PB, the respective bits are PB6 and PB7, and so on for pixels PC and PD.

Figure 6:
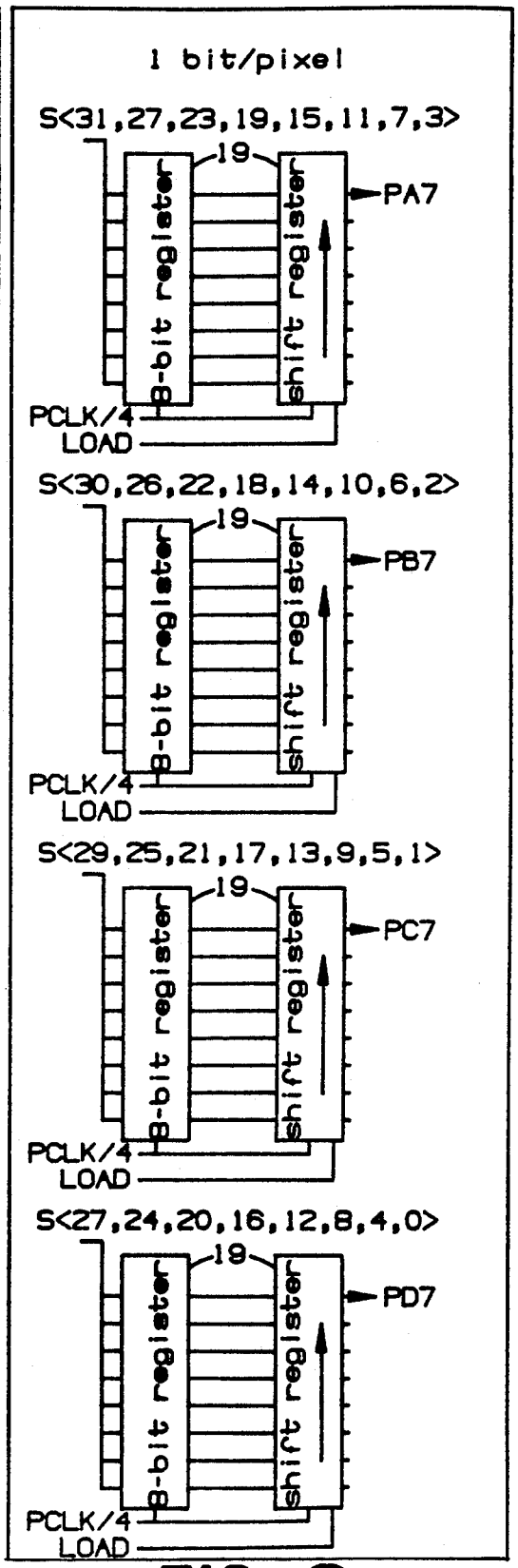
FIG. 6 is a schematic diagram of a programmable gate array programmed to produce data at the rate of one bit per pixel to be displayed.

The final possible variation is that which is illustrated in FIG. 6 of the drawings. In that case, the command is given to shift register 25 to load data from first eight-bit register 21 and to produce pixels having one bit each. For pixel PA, the sole bit of data is then PA7. For pixel PB, the sole bit of data is then PB7, and so on for pixels PC and PD.

In modes other than the eight-bit mode, "PIXMUX" must reformat the data received from first eight-bit register 21. The data input to chip device 19 still comprises 32 bits, which represents more than sufficient data for four pixels unless the pixels are to have eight bits each. Nevertheless, the output of chip device 19 is still four pixels. Thus, the data input to chip device 19 must be slowed down so that multiple cycles of four pixels each can be generated and outputted from a single input data field of 32 bits. For example, in the two-bits-per-pixel mode, the output data will comprise eight bits in total, but the input data are still 32 bits. Hence, the input data rate must be slowed to one-quarter of the output data rate. The eight-bit output (four pixels of two bits each) must go through four cycles to output a total of 16 pixels before the input data change. The four pixels having from one to eight bits apiece, as the case may be, then go from chip device 19 to color-look-up table 27, which enhances the resolution of those pixels. There is an entry in color-look-up table 27 for the address of each pixel to be displayed.

The entry in color-look-up table 27 for the address of each pixel to be displayed must be "loaded" into the table from a "palette" of color data. The value of each such entry depends upon the number of bits of data that have been allotted to each pixel to be displayed. The values of the respective entries in the color-look-up table for all the addresses in the table are derived from host computer and microprocessor 11 via bus structure 15, as shown in FIG. 1 of the drawings.

The color data produced by color-look-up table 27 are stored in internal memory until needed. The output of color-look-up table 27, representing the intensities of the three primary colors that are required for the display, then goes to a digital-to-analog converter 31. Thus, the train of pulses in each digital signal representing the intensity of a primary color is converted into an analog signal expressive of the same primary color. Analog signals of this nature actuate the color electron guns of cathode-ray-tube display device 33. In the implementation of color-look-up table 27 and digital-to-analog converter 31, it is convenient to employ a chip device manufactured and marketed by Brooktree Corporation of San Diego, Calif. under the trademark "RAMDAC" and which integrates in a single device the functions of the color-look-up table, the digital-to-analog converter, and internal memory.

Returning to the operation of chip device 19, it is noteworthy that, when the device is operating in any mode other than the eight-bit mode, the shift registers perform a function of parallel-to-serial conversion in order to compensate for the difference between the rate of data input to and the rate of data output from chip device 19. Another significant characteristic of this invention is found in the selection among the various internal configurations of "PIXMUX." FIGS. 3 through 6 of the drawings illustrate the internal organization of the registers within chip device 19. As shown in those figures, the internal organization of the registers defines the way in which the output bits from chip device 19 correspond to the input bits to that device to satisfy the currently prevailing requirement concerning the number of bits per output pixel.

The pixel-data controller in accordance with this invention has been fully described in its most-favored configuration, representing the best mode known to the inventor. In practice, variations in the configuration may be made without departing from the scope of the invention. Accordingly, the invention is defined with particularity in the appended claims.

What I claim as new and desire to secure by Letters Patent of the United States is as follows:

1. A pixel-data processor for manipulating data in computer graphics comprising:

(a) means, including a microprocessor, for developing configuration data and address and color data for pixels that together are to comprise an image on a graphic-display device, (b) a frame-buffer memory for temporarily storing said address data, and for forwarding it in response to a clock signal, (c) a pixel-data controller for receiving address data from said frame-buffer memory and configuration data from said microprocessor, said pixel-data controller including a programmable gate array being configurable by said configuration data to operate in at least two modes, said progammable gate array being configurable in a first mode as eight-bit registers to receive and forward address data for four pixels each having eight bits, and being configurable in a second mode as a combination of eight-bit registers and shift registers to receive, shift, and forward address data for four pixels each having one, two, or four bits as determined by said configuration data, (d) said registers of said pixel-data controller further being arrayed to forward simultaneously address data for four pixels of graphic display, each having one, two, four, or eight bits as determined by said configuration data, (e) color-look-up-table means for receiving address data for four pixels of graphic display simultaneously forwarded by said pixel-data controller and for enhancing said address data, and (f) means for converting said enhanced pixel data from digital to analog form.

2. A pixel-data processor in accordance with claim 1, further including program-memory means for controlling said microprocessor.

3. A pixel-data processor in accordance with claim 1, further including means for controllably loading color-palette data into said color-look-up-table means.

4. A pixel-data processor in accordance with claim 1, further including display means actuated by said enhanced pixel data in analog form.

5. A pixel-data processor in accordance with claim 4 wherein said display means is a color cathode-ray tube.

6. A pixel-data processor in accordance with claim 1, further including first bus means coupling said microprocessor to said frame-buffer memory.

7. A pixel-data processor in accordance with claim 6 wherein the capacity of said first bus means is at least 32 bits.

8. A pixel-data processor in accordance with claim 1, further including second bus means coupling said frame-buffer memory to said pixel-data controller.

9. A pixel-data processor in accordance with claim 8 wherein the capacity of said second bus means is at least 32 bits.

10. A pixel processor in accordance with claim 1, wherein said shift registers are strobed by a clock signal having a frequency equal to one-quarter the rate of desired production of pixel data for said graphic-display device.

* * * * *